US007837133B2

(12) United States Patent
Zhou

(10) Patent No.: US 7,837,133 B2
(45) Date of Patent: Nov. 23, 2010

(54) COMPOSITE SHOWER HEAD

(76) Inventor: Huasong Zhou, Rm 704, #135, Hubin S. Road, Xiamen, Fujian (CN)

( * ) Notice: Subject to any disclaimer, the term of this patent is extended or adjusted under 35 U.S.C. 154(b) by 627 days.

(21) Appl. No.: 11/624,639

(22) Filed: Jan. 18, 2007

(65) Prior Publication Data

US 2008/0073446 A1 Mar. 27, 2008

(30) Foreign Application Priority Data

Sep. 25, 2006 (CN) ..... 2006 2 0065207 U

(51) Int. Cl.

| | |
|---|---|
| ***B05B 15/06*** | (2006.01) |
| ***B05B 17/00*** | (2006.01) |
| ***B05B 1/14*** | (2006.01) |
| ***B05B 1/00*** | (2006.01) |
| ***A62C 31/02*** | (2006.01) |

(52) U.S. Cl. ..... 239/392; 239/282; 239/289; 239/390; 239/550; 239/600

(58) Field of Classification Search ..... 239/282, 239/289, 390, 391, 392, 394, 397, 548, 550, 239/551, 552, 554, 600; 403/92, 97, 101, 403/326, 327, 328, 361

See application file for complete search history.

(56) References Cited

U.S. PATENT DOCUMENTS

| | | | | |
|---|---|---|---|---|
| 4,579,476 | A * | 4/1986 | Post | 403/322.2 |
| 2005/0098661 | A1 * | 5/2005 | Lev | 239/550 |
| 2007/0158460 | A1 * | 7/2007 | Lev | 239/132.1 |

* cited by examiner

*Primary Examiner*—Len Tran
*Assistant Examiner*—Ryan Reis
(74) *Attorney, Agent, or Firm*—Rabin & Berdo, P.C.

(57) ABSTRACT

The present invention provides a composite shower head typically comprised of a hand-hold shower head and a fixed shower head, wherein said hand-hold shower head has a retaining pass corresponding to the fixed shower head; said fixed shower head can be held in the retaining pass of said hand-hold shower head; a locking device is built on for locking the hand-hold shower head with the fixed shower head together. The composite shower head combining the fixed shower head and the hand-hold shower head together into one assembled body simplifies the shower site, and facilitates to use, meanwhile meets to economic style of modern people.

6 Claims, 2 Drawing Sheets

COMPOSITE SHOWER HEAD

BACKGROUND OF THE INVENTION

1. Field of the Invention

The present invention relates to bathroom appliances, and more particularly to a composite shower head.

2. Description of Prior Art

In accordance with the conventional technology, most of the shower heads are fixed above the head of user, meanwhile a hand-hold shower head is equipped for moving at will, in this way, the user can be convenient to select showing way. But, when the hand-hold shower head is not used, it must be located in a place, so a shower stationary rest should be fixed on the wall at proper position, or a shower adjustment rail, or the fixed shower head, separating with the fixed shower head, such like in the shower site, multiple shower heads are presented affecting looking view, and not meeting to economic style of modern people.

OBJECTS AND SUMMARY OF THE INVENTION

It is therefore a main object of the present invention to provide a composite shower head combining a shower head and a hand-hold shower head into one composite body, which can be took apart only in necessary time.

For achieving the above-mentioned object, the present invention provides a composite shower head typically comprised of a hand-hold shower head and a fixed shower head; wherein said hand-hold shower head has a retaining pass corresponding to the fixed shower head; said fixed shower head can be held in the retaining pass of said hand-hold shower head; a locking device is built on for locking the hand-hold shower head with the fixed shower head together.

Said locking device includes one or more locking studs built on the inside of the hand-hold shower head and a coordinated catching groove built on the outside wall of the fixed shower head, in which said locking studs is controlled by a sliding button built upon the side wall of the retaining pass to stretch out from the hand-hold shower head to lock into the catching groove of the fixed shower head or to draw back from the catching groove to release the fixed shower head, and springs built upon the inside of the hand-hold shower head for keeping the locking studs extending out into the inside of the retaining pass always without any extra force drawing back.

Said locking device includes one or more locking studs built on the inside of the fixed shower head and one or a catching groove built on the inside wall of the retaining pass of the hand-hold shower head, in which said locking studs is controlled by a sliding button built upon the side wall of the fixed shower head to stretch out from the fixed shower head to lock into the catching groove on the retaining pass of the hand-hold shower head or to draw back from the catching groove to release the hand-hold shower head, and springs built upon the inside of the fixed shower head for keeping the locking studs extending out from the outside wall of the fixed shower head always without any extra force drawing back.

Said locking device is a pair of a trip and a ring groove built separately on the fixed shower head and the hand-hold shower head.

Said locking device is a pair of matching threads, a male thread and a female thread, built separately upon the fixed shower head and the hand-hold shower head.

As utilizing above-mentioned structure, in practice, because the hand-hold shower head is located on the fixed shower head directly to form an integrated top spraying state, and the hand-hold shower head does not need to be attached with shower stationary rest built on the wall; when the user tends to use the hand-hold shower head, just need to take apart the hand-hold shower head from the fixed shower head to hold to any where at will. In this way, the composite shower head combining the fixed shower head and the hand-hold shower head together into one assembled body simplifies the shower site, and facilitates to use, meanwhile meets to economic style of modern people.

DETAILED DESCRIPTION OF PREFERRED EMBODIMENTS

Figure 1:
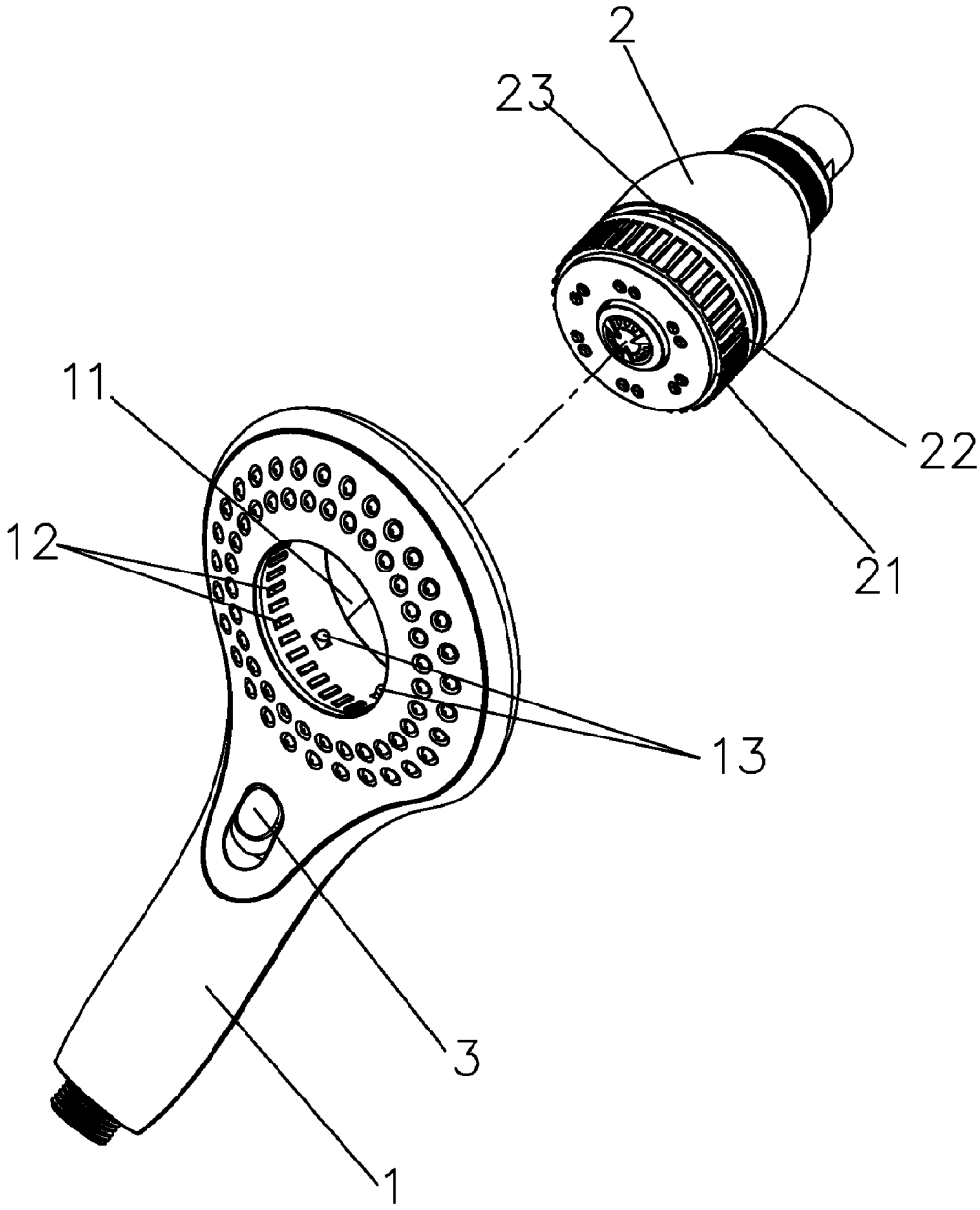
FIG. 1 is an exploded view of the present invention.
Figure 2:
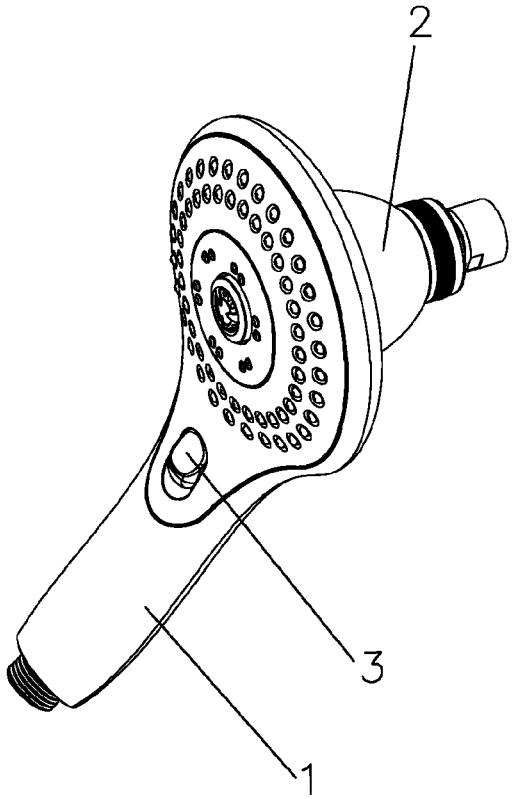
FIG. 2 is a perspective sectional view showing the combination state of the present invention.

Referring to FIG. 1 and FIG. 2, a composite shower head discovered by the present invention is typically comprised of a hand-hold shower head 1, and a fixed shower head 2.

Wherein, said hand-hold shower head 1 has a retaining pass 11 coordinating to the fixed shower head 2, and proper number of gearing projections 12 built on the inside wall along the edge.

Said fixed shower head 2 can be held in the inside of the retaining pass 11 of the hand-hold shower head 1, and has an adjusting ring 21 built on the front panel for adjusting the spraying styles according to the necessary, there are a number of gearing slots 22 corresponding to the gearing projections 12 for gearing together and locating.

Figure 3:
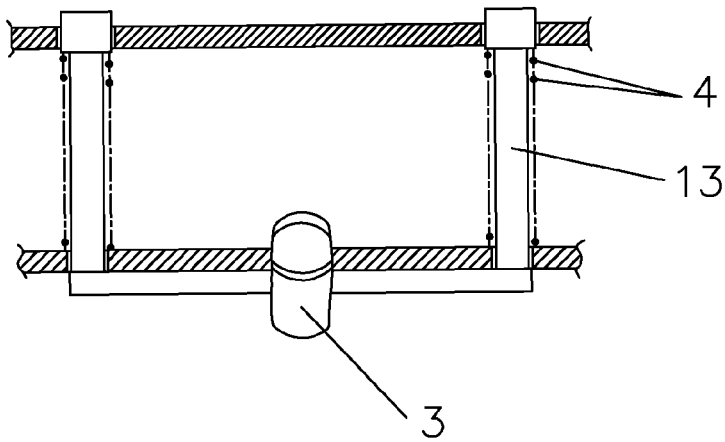
FIG. 3 is a cross-section view showing the locking device of the present invention.

On the other head, a locking device can be built on between said hand-hold shower head 1 and the fixed shower head 2 (referring to FIG. 3), said locking device includes one or more locking studs 13 built on the inside of the hand-hold shower head 1 and one or more coordinated catching groove 23 built on the outside wall of the fixed shower head 2, in which said locking studs 13 is controlled by a sliding button 3 built upon the side wall of the retaining pass 11 to stretch out from the hand-hold shower head 1 to lock into the catching groove 23 of the fixed shower head 2 or to draw back from the catching groove 23 to release the fixed shower head 2, and springs 4 built upon the inside of the hand-hold shower head 1 for keeping the locking studs 13 extending out into the inside of the retaining pass 11 always until an extra force drawing them back.

In combination, fit the retaining pass 11 of the hand-hold shower head 1 on the fixed shower head 2 until the locking studs 13 catch into the catching groove 23 of the fixed shower head 2 exactly, meanwhile the gearing projections 12 on the retaining pass 11 are matching on the gearing slots 22 of the fixed shower head 2, so the hand-hold shower head 1 is combined on the fixed shower head 2, in this time, the composite shower head combined by the hand-hold shower head 1 and the fixed shower head 2 is in top side spraying state, the user can turn the hand-hold shower head 1 to adjust the spraying style of the fixed shower head 2 by the geared gearing projections 12 and the gearing slots 22 directly.

It is stressed that the locking device locking the hand-hold shower head 1 and the fixed shower head 2 together can exchange the positions of the locking studs and the catching groove, such as the catching groove is built on the inside wall of the retaining pass of the hand-hold shower head, and the locking studs can be built on the outside wall of the fixed shower head, in the same way the sliding button and the springs are also built on the inside of the fixed shower head. Additionally, said locking device is not limited above description, it also can be a pair of a trip and a ring groove, or a pair of gearing threads and so on.

On the other hand, said holding mechanism built on between the hand-hold shower head 1 and the adjusting ring 21 of said fixed shower head 2 also is not limited in matching projections 12 and the gearing slots 22 structure, it can be all the non-circle rotatable matching mechanisms.

I claim:

1. A composite shower head typically comprised of a hand-hold shower head and a fixed shower head, wherein said hand-hold shower head has a retaining pass corresponding to the fixed shower head; said fixed shower head can be held in the retaining pass of said hand-hold shower head; a locking device is built on for locking the hand-hold shower head with the fixed shower head together, wherein said locking device includes one or more locking studs built on the inside of the hand-hold shower head and a coordinated catching groove built on the outside wall of the fixed shower head, in which said locking studs is controlled by a sliding button built upon the side wall of the retaining pass to stretch out from the hand-hold shower head to lock into the catching groove of the fixed shower head or to draw back from the catching groove to release the fixed shower head, and springs built upon the inside of the hand-hold shower head for keeping the locking studs extending out into the inside of the retaining pass always without any extra force drawing back.

2. A composite shower head typically comprised of a hand-hold shower head and a fixed shower head, wherein said hand-hold shower head has a retaining pass corresponding to the fixed shower head; said fixed shower head can be held in the retaining pass of said hand-hold shower head; a locking device is built on for locking the hand-hold shower head with the fixed shower head together, wherein said locking device is a pair of matching threads, a male thread and a female thread, built separately upon the fixed shower head and the hand-hold shower head.

3. A composite shower head as claimed in claim 1, wherein said fixed shower head has an adjusting ring built on the front panel controlling the spraying style by turning, coordinating to it, said hand-hold shower head has a holding mechanism so as to make the hand-hold shower head and the adjusting ring turn synchronously.

4. A composite shower head typically comprised of a hand-hold shower head and a fixed shower head, wherein said hand-hold shower head has a retaining pass corresponding to the fixed shower head; said fixed shower head can be held in the retaining pass of said hand-hold shower head; a locking device is built on for locking the hand-hold shower head with the fixed shower head together, wherein said fixed shower head has an adjusting ring built on the front panel controlling the spraying style by turning, coordinating to it, said hand-hold shower head has a holding mechanism so as to make the hand-hold shower head and the adjusting ring turn synchronously, and said holding mechanism is a pair of a set of gearing slots and a set of gearing projections separately built on the outside end of the adjusting ring and the inside wall of the retaining pass of the hand-hold shower head.

5. A composite shower head as claimed in claim 3, wherein said holding mechanism is a pair of a set of gearing slots and a set of gearing projections separately built on the outside end of the adjusting ring and the inside wall of the retaining pass of the hand-hold shower head.

6. A composite shower head typically comprised of a hand-hold shower head and a fixed shower head, wherein said hand-hold shower head has a retaining pass corresponding to the fixed shower head; said fixed shower head can be held in the retaining pass of said hand-hold shower head; a locking device is built on for locking the hand-hold shower head with the fixed shower head together, wherein said locking device includes one or more locking studs built on the inside of the fixed shower head and a coordinated catching groove built on the inside wall of the retaining pass of the hand-hold shower head, in which said locking studs is controlled by a sliding button built upon the side wall of the fixed shower head to stretch out from the fixed shower head to lock into the catching groove on the retaining pass of the hand-hold shower head or to draw back from the catching groove to release the hand-hold shower head, and springs built upon the inside of the fixed shower head for keeping the locking studs extending out from the outside wall of the fixed shower head always without any extra force drawing back, said fixed shower head has an adjusting ring built on the front panel controlling the spraying style by turning, coordinating to it, said hand-hold shower head has a holding mechanism so as to make the hand-hold shower head and the adjusting ring turn synchronously, and said holding mechanism is a pair of a set of gearing slots and a set of gearing projections separately built on the outside end of the adjusting ring and the inside wall of the retaining pass of the hand-hold shower head.

* * * * *